United States Patent [19]

Liggett et al.

[11] Patent Number: 4,769,927

[45] Date of Patent: Sep. 13, 1988

[54] ATHLETIC SHOE

[75] Inventors: Steven Liggett, North Easton; Paul D. Brown, Hingham; Edward Lussier, Hanover, all of Mass.

[73] Assignee: Reebok International Ltd., Canton, Mass.

[21] Appl. No.: 931,733

[22] Filed: Nov. 17, 1986

[51] Int. Cl.[4] ..... A43B 7/14; A43B 5/00

[52] U.S. Cl. ..... 36/88; 36/114; 36/50

[58] Field of Search ..... 36/114, 50, 45, 88, 36/58.5, 43, 69, 30 R

[56] References Cited

U.S. PATENT DOCUMENTS

| | | | |
|---|---|---|---|
| 4,069,601 | 1/1978 | Robbins et al. | 36/32 R |
| 4,085,527 | 4/1978 | Riggs | 36/32 R |
| 4,245,408 | 1/1981 | Larsen et al. | 36/50 |
| 4,255,876 | 3/1981 | Johnson | 36/50 |
| 4,259,792 | 4/1981 | Halberstadt | 36/30 R |
| 4,322,895 | 4/1982 | Hockerson | 36/69 |
| 4,345,387 | 8/1982 | Daswick | 36/43 |
| 4,354,318 | 10/1982 | Frederick et al. | 36/69 |
| 4,413,431 | 11/1983 | Cavanagh | 36/114 |
| 4,447,967 | 5/1984 | Zaino | 36/45 |
| 4,521,979 | 6/1985 | Blaser | 36/43 |
| 4,534,121 | 8/1985 | Autry | 36/43 |
| 4,577,419 | 3/1986 | Chassaing | 36/114 |
| 4,594,798 | 6/1986 | Autry et al. | 36/114 |
| 4,616,432 | 10/1986 | Bunch et al. | 36/114 |
| 4,644,673 | 2/1987 | Gamm | 36/114 |

FOREIGN PATENT DOCUMENTS

| | | | |
|---|---|---|---|
| 3415960 | 11/1984 | Fed. Rep. of Germany | 36/57 |
| 3344764 | 6/1985 | Fed. Rep. of Germany | 36/43 |

*Primary Examiner*—Steven N. Meyers

*Attorney, Agent, or Firm*—Saidman, Sterne, Kessler & Goldstein

[57] ABSTRACT

A laced, lightweight athletic shoe which provides enhanced foot stability and comfort includes a top of a lightweight, flexible material, a U-shaped lacing margin stitched to the top and defining a lacing opening, and a reinforcing cover stitched to an overlying portion of the top. Inner and outer lateral straps form part of the reinforcing cover and extend upwardly from opposite sides of the front portion of the cover to the lacing opening and overlie the lacing margin. A stabilizing strap made of a non-stretchable material such as polyurethane underlies one or both of the lateral straps and extends from the lasting margin to the lacing opening to reinforce the upper and provide lateral stability to the foot of the wearer. The shoe further includes a removable insert comprising a resilient material having a pattern of resilient dimples over its bottom surface for shock absorption. The shoe is provided with a midsole having a dished upper surface including an upwardly extending flange around the periphery of the rear and sides, extending forwardly to the ball of the foot. The flange restrains movement of the rear portion of the wearer's foot in relation to the midsole.

10 Claims, 2 Drawing Sheets

ATHLETIC SHOE

FIELD OF THE INVENTION

This invention relates to the construction of athletic shoes for running, tennis, basketball and the like and, more particularly, to an athletic shoe which provides enhanced foot stability and comfort.

BACKGROUND OF THE INVENTION

Each time the foot of a runner contacts the ground, considerable force is transmitted through the shoe to the runner's foot. This force tends to push the foot forward in the shoe, causing discomfort. The forward force is offset by friction between the shoe and the foot and by the lacing. In addition, lateral forces cause relative lateral motion between the foot and shoe. These lateral forces not only produce fatigue in the runner's foot, but also tend to stretch and wear the shoe, particularly in the metatarsal region. Also, the lateral forces can offset the upper part of the shoe from the sole such that the runner's foot is not properly aligned over the sole.

An additional force during running is the longitudinal shock transmitted directly from the sole to the runner's foot and leg. This shock can result in runner fatigue and discomfort.

Numerous shoe constructions are shown in the prior art for alleviating the discomfort and wear caused by these forces. U.S. Pat. No. 4,413,431 discloses a shoe with a one-piece reinforcement which extends about the lacing opening and has lateral reinforcing portions. Athletic shoes having lateral reinforcing strips have also been shown in U.S. Pat. Nos. 4,245,408, 4,255,876 and 4,447,967. The prior art structures have certain disadvantages such as a tendency to stretch during use, inability to withstand prolonged wear and lack of wearer comfort. U.S. Pat. No. 4,348,821 discloses a sole structure composed of two parts wherein a rigid upper support member is contoured. The upper support member extends from the heel to the middle part of the ball region and is used in combination with a flexible sole contoured to receive the stiff upper support member. Footwear having projections upwardly extending from a sole toward the wearer's foot are shown in U.S. Pat. Nos. 3,589,037 and 4,095,353.

It is an object of the present invention to provide an athletic shoe having a lateral reinforcing strap to prevent lateral foot movement and extend shoe life.

It is a further object of the present invention to provide an athletic shoe with a dished midsole having an upwardly extending peripheral flange for foot stability.

It is a further object of the present invention to provide an athletic shoe having a removable insert with dimples covering the bottom surface thereof for shock absorption.

It is a further object of the present invention to provide an athletic shoe including a combination of features which improve foot stability and comfort.

SUMMARY OF THE INVENTION

According to the present invention, these and other objects and advantages are achieved in a laced, lightweight athletic shoe comprising an upper and a sole joined at a lasting margin, the upper including a top made of a light, flexible material, a U-shaped lacing margin stitched to the top and defining a lacing opening for the upper, a reinforcing cover stitched to and overlying a portion of the top, and inner and outer lateral straps forming part of the reinforcing cover and extending upwardly from opposite sides of the front portion of the cover to the lacing opening adjacent the forward portion thereof, and overlying the lacing margin.

In one unique feature of the present invention, there is provided a stabilizing strap made of non-stretchable material underlying the outer lateral strap and extending through the lasting margin to the lacing opening to reinforce the upper and provide lateral stability to the foot of the wearer. Preferably, the outer lateral strap and the stabilizing strap each extend across a lacing hole and have holes therethrough aligned with the lacing hole. Preferably, the stabilizing strap and the outer lateral strap increase in width in a direction from the lacing margin toward the lasting margin. The stabilizing strap is preferably made of non-stretchable polyurethane and extends into the sole portion of the shoe and is secured to the sole.

In another unique feature of the present invention, the athletic shoe is provided with a removable insert for positioning in the bottom interior of the shoe. The insert comprises a lightweight, resilient material having a pattern of resilient dimples over a major portion of its bottom surface for shock absorption.

In a further unique feature of the present invention, the athletic shoe is provided with a midsole intermediate an outersole and the insert. The midsole has a dished upper surface, including an upwardly extending flange around the periphery of the rear and sides, extending forwardly to the ball of the foot. The flange restrains movement of the rear portion of the wearer's foot in relation to the midsole.

BRIEF DESCRIPTION OF THE DRAWINGS

For a better understanding of the present invention together with other and further objects, advantages and capabilities thereof, reference may be had to the accompanying drawings in which.

DETAILED DESCRIPTION OF THE INVENTION

Figure 1:
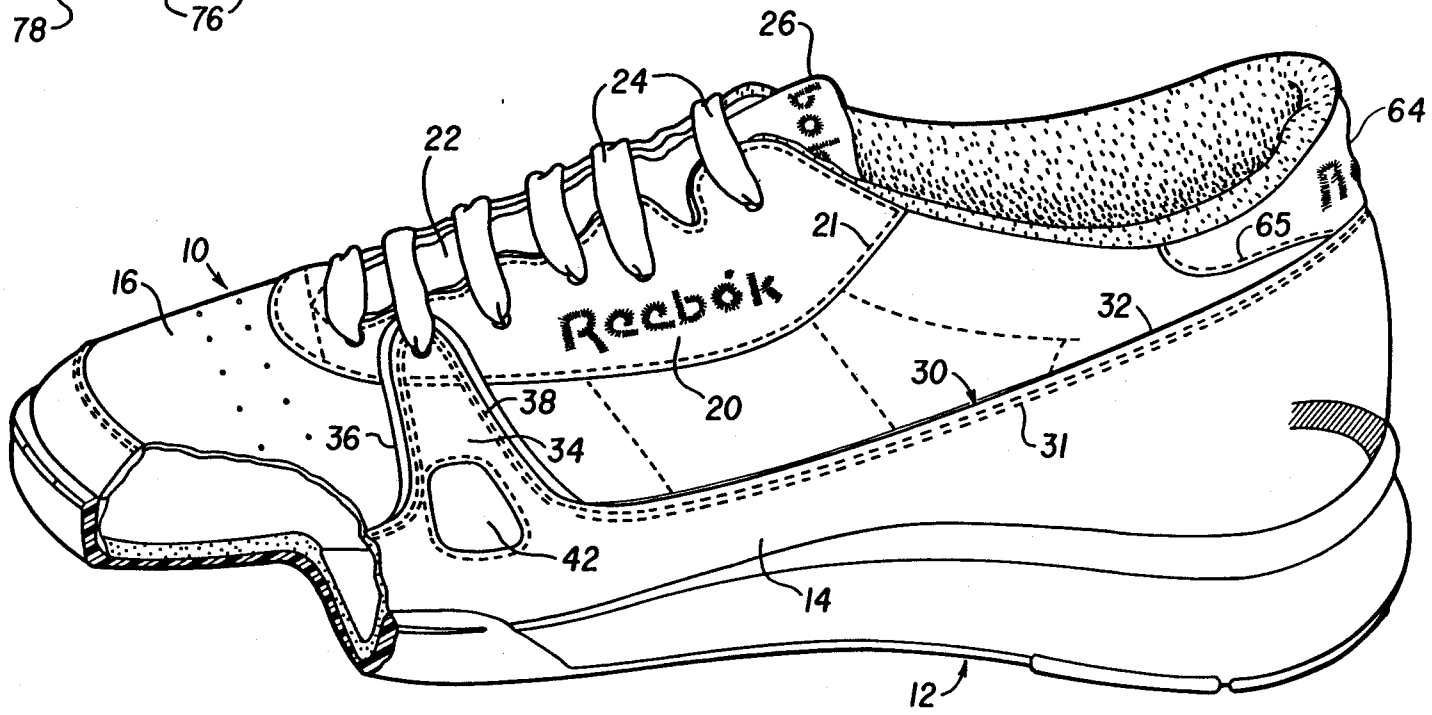
FIG. 1 is a perspective view of an athletic shoe in accordance with the present invention, partially cut away to illustrate features thereof.

A laced, lightweight athletic shoe in accordance with the present invention is shown in FIG. 1. An upper 10 is joined to a sole 12 at a lasting margin 14. A top 16, or vamp, of a light, flexible material such as leather extends from the rear of the heel along the sides and covers the toe portion. A U-shaped lacing margin 20 is stitched 21 to the top 16 and defines a lacing opening 22. The lacing margin 20 is provided with a plurality of lacing holes 24. A tongue 26 underlies the lacing margin 20 and the lacing opening 22. A leather reinforcing cover 30 overlies and is stitched 31 to a portion of the top and extends upwardly from lasting margin 14 and from the front of the top 16 around the toe portion to the heel. The rear portion of the cover 30 defines a counter 32 that extends forward toward the toe to the region of the ball of the foot. An outer lateral strap 34 and an inner lateral strap (not shown) form part of the reinforcing cover 30 and extend upwardly from opposite sides of the front of the counter 32 over the top 16 to the lacing opening 22 adjacent the forward portion thereof and overlying the lacing margin 20. A heel reinforcement strip 64 is stitched 65 to the upper portion of the heel for preventing wear and breakdown thereof. The interior of the shoe is preferably covered, at least in part, with a terry cloth material for comfort and moisture absorption.

A stabilizing strap 36, or metatarsal strap, made of a non-stretchable material such as polyurethane, underlies the outer lateral strap 34 and extends from the lacing opening 22 downwardly to the lasting margin 14 is turned under and onto the sole of the shoe. Depending on the intended use of the shoe, a stabilizing strap can also be utilized under the inner lateral strap to further stabilize the wearer's foot. In basketball and court shoes, stabilizing straps are preferably used under both the inner and outer lateral straps, while a single stabilizing strap under the outer lateral strap is adequate for shoes normally used in less strenuous activities. The stabilizing strap or straps are useful in both low and high shoes, particularly for improving foot stability and to a less extent for preventing stretching of the shoe. In some cases a single stabilizing strap can be used acting to underlie both an inner and outer lateral strap with the stabilizing strap having a central bottom portion spanning across the top of the shoe outersole and forming a stabilizer for an inner and outer lateral strap on either side of a shoe.

The stabilizing strap 36 extends across a portion of the sole 12 and is secured thereto by adhesive or stitching. The lateral strap 34 and the underlying stabilizing strap 36 extend across at least one of the lacing holes 24 and have holes 38, 40 therethrough aligned with the lacing hole 24 across which they extend. When the shoe is laced, the lace passes through hole 38 in the outer lateral strap 34 and hole 40 in the stabilizing strap 36, thereby drawing the straps 34, 36 snugly against the wearer's foot. The lateral strap 34 and the stabilizing strap 36 can extend across two or more lacing holes 24, if desired, for even greater stability.

The lateral strap 34 and the stabilizing strap 36 are stitched 38 together over a major portion of their periphery. In addition, the lateral strap 34 and the stabilizing strap 36 are together stitched to the underlying portion of the top 16. The outer lateral strap 34 includes an opening 42 which exposes the underlying stabilizing strap 36, principally for enhanced appearance.

The outer lateral strap 34 and the underlying stabilizing strap 36 are tapered such that they increase in width in a direction from the lacing opening 22 toward the lasting margin 14. The tapered straps provide improved strength in comparison with reinforcing straps of uniform width. Preferably the stabilizing strap is a polyurethane. The thickness can vary greatly but sufficient thickness is provided to give the required strength. In addition, straps 34, 36 are relatively wide in the lower portion adjacent the lasting margin 14, thereby restraining the wearer's foot over a relatively large area. This wide structure tends to eliminate the discomfort normally associated with narrow straps which apply concentrated forces to the foot. Furthermore, the double strap structure with a non-stretchable stabilizing strap 36 provides lateral stability heretofore unavailable with leather reinforcing straps. As is well-known in the art, leather has a tendency to stretch. An additional advantage of the stabilizing strap 36 is the fact that it extends into the sole portion of the shoe and is securely anchored over a broad area, further inhibiting the tendency for the strap to work loose or stretch during the life of the shoe.

Figure 2A:
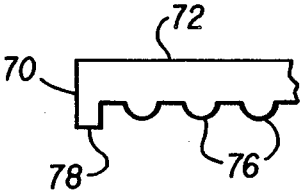
FIG. 2A is a partial cross-sectional view of the removable insert.
Figure 2:
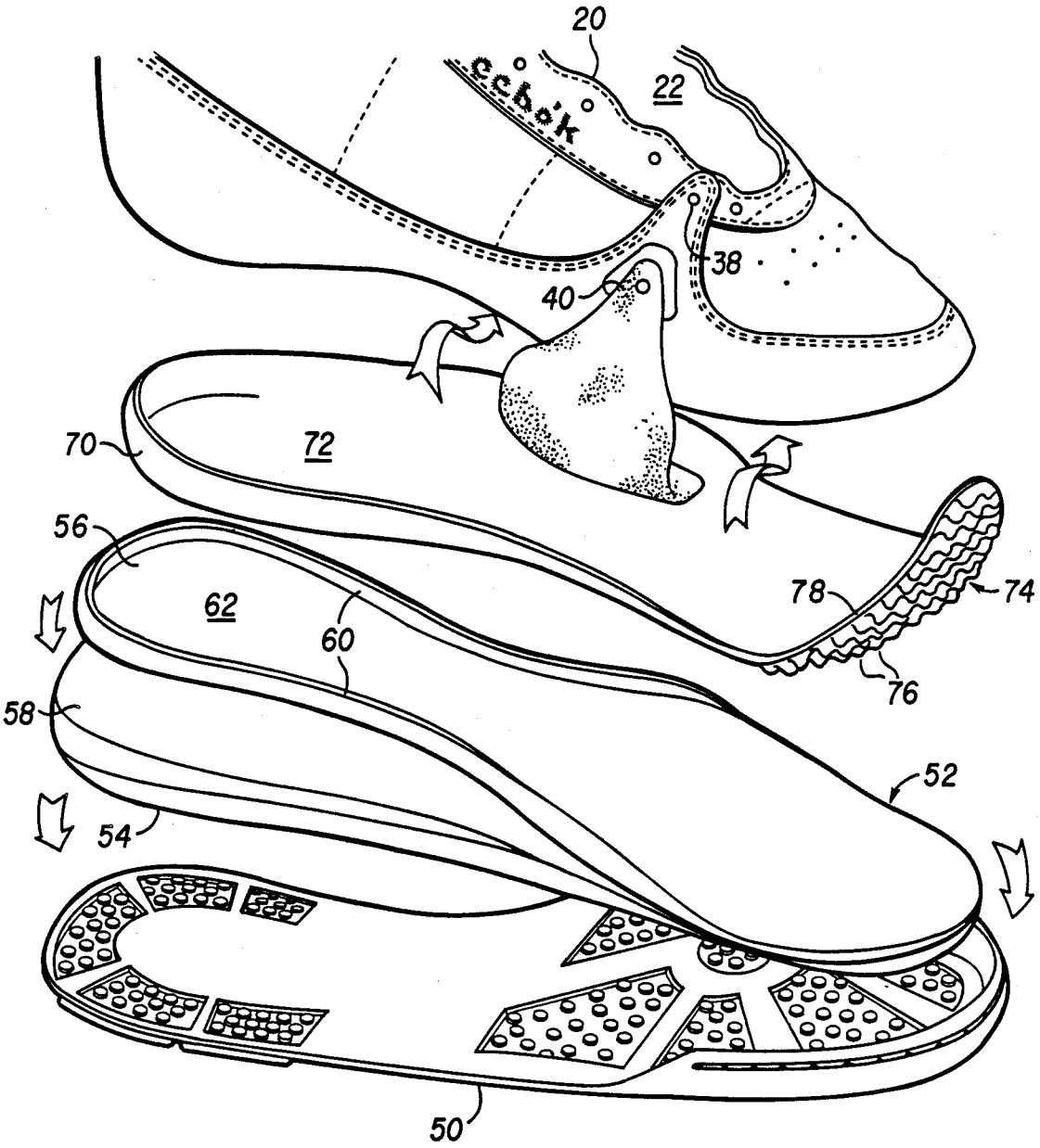
FIG. 2 is an exploded view of the athletic shoe in accordance with the present invention.

The structure of the sole 12 is best seen with reference to FIG. 2. An outersole 50 made of rubber or a similar material, of generally flat construction, contacts the ground. The outersole 50 can be provided with any of a number of well-known designs to enhance traction. The periphery of the toe portion preferably extends upwardly and is reinforced for protection of the shoe and the wearer. A midsole 52 has a multilayer design including a relatively soft lower midsole 54, a dished upper midsole 56 and a relatively firm wedge 58 positioned between the lower midsole 54 and the upper midsole 56. The wedge 58 is thickest at the heel and tapers to zero thickness near the ball of the foot. The upper midsole 56 is preferably a molded polyurethane having a peripheral flange or lip 60 extending from the heel along both sides to the ball of the foot. The flange 60 extends upwardly from a generally flat base 62. The dished, or contoured, upper midsole 56 restrains the rear portion of the wearer's foot from moving laterally or rearwardly with respect to the upper midsole 56. While the midsole 52 has been shown and described as a multiple layer structure, it will be understood that various ones of the layers can be combined into an integral unit. When the stabilizing straps described above and the dished midsole construction are combined in the same shoe, it can be seen that lateral movement of the wearer's foot is restrained both at the front and the rear.

The athletic shoe of the present invention is further provided with an easily removable insert 70, which is placed in the bottom interior of the shoe above the midsole 52 and directly contacts the wearer's foot. The insert 70 is preferably a resilient material such as an elastomer which can be molded to have an upper surface contour that matches the wearer's foot. A terry cloth moisture absorption layer 72 is preferably cemented to the upper surface of the insert 70. The bottom surface 74 is covered with resilient dimples 76, or projections, for absorption of shock (see FIG. 2A). The dimples 76 are molded as an integral part of the insert 70. The bottom surface 74 is also provided with an integrally molded peripheral flange 78.

While there has been shown and described what is at present considered the preferred embodiment of the present invention, it will be obvious to those skilled in the art that various changes and modifications may be made therein without departing from the scope of the invention as defined by the appended claims.

What is claimed is:

1. A laced, lightweight athletic shoe comprising an upper and a sole joined at a lasting margin, said upper including a top made of a light, flexible material, a U-shaped lacing margin stitched to the top and defining a lacing opening for the upper, a reinforcing cover stitched to and overlying a portion of the top and extending upwardly from the lasting margin and from the front of the top to the rear of the heel, the rear portion of the cover defining a counter that extends forward toward the toe to the region of the ball of the foot, inner and outer lateral straps forming part of the reinforcing cover and extending upwardly from opposite sides of the front of the counter portion of the cover to the lacing opening adjacent the forward portion thereof and overlying the lacing margin, and a stabilizing strap made of a non-stretchable material underlying at least one of the lateral straps and extending from the lasting margin to the lacing opening to reinforce the upper and provide lateral stability to the foot of the wearer.

2. An athletic shoe as defined in claim 1 further characterized by said stabilizing strap being stitched to the lateral strap about the periphery thereof.

3. An athletic shoe as defined in claim 1 further characterized by lacing holes disposed on each side of the lacing opening in the lacing margin, said lateral straps each extending across at least one lacing hole and having a hole therethrough aligned with the hole across which the lateral strap extends, and said stabilizing strap having a hole aligned with the hole in the lateral strap.

4. An athletic shoe as defined in claim 3 further characterized by said stabilizing strap being stitched to the lateral strap about the periphery thereof.

5. An athletic shoe as defined in claim 1 wherein said stabilizing strap and said lateral strap increase in width in a direction from said lacing margin toward said lasting margin.

6. An athletic shoe as defined in claim 1 wherein said stabilizing strap extends continuously from said lasting margin into said sole and is secured to said sole.

7. An athletic shoe as defined in claim 1 wherein said stabilizing strap is made of non-stretchable polyurethane.

8. An athletic shoe as defined in claim 4 wherein said lateral strap and said stabilizing strap are stitched securely to said top.

9. An athletic shoe as defined in claim 1 further including a removable insert adapted to be placed in the bottom interior of the shoe, said removable insert being of a resilient material and having a bottom surface covered with a pattern of resilient dimples for shock absorption.

10. An athletic shoe as defined in claim 1 wherein the sole comprises an outersole which contacts the ground and a midsole between the outersole and the wearer's foot, said midsole having a dished upper surface with an upwardly extending peripheral flange around the rear and sides thereof for rearfoot stability.

* * * * *